United States Patent [19]

Smith

[11] 3,987,897

[45] Oct. 26, 1976

[54] LABEL ROLL PACKAGE

[75] Inventor: Thomas M. Smith, Dayton, Ohio

[73] Assignee: Monarch Marking Systems, Inc., Dayton, Ohio

[22] Filed: Apr. 7, 1975

[21] Appl. No.: 566,001

[52] U.S. Cl. ..... 206/226; 206/394; 206/459; 206/497

[51] Int. Cl.[2] ..... B65D 79/00; B65D 75/54; B65D 85/672

[58] Field of Search ..... 206/226, 394, 395, 459, 206/497, 410, 411, 45.33, 205; 242/55.2, 55.3, 55.53

[56] References Cited

UNITED STATES PATENTS

| | | | |
|---|---|---|---|
| 1,924,645 | 8/1933 | Macklanburg | 242/55.2 |
| 2,005,135 | 6/1935 | Esterson | 206/459 X |
| 2,142,470 | 1/1939 | Claff | 206/459 X |
| 2,346,219 | 4/1944 | Johnson | 206/390 X |
| 2,454,352 | 11/1948 | Staunton et al. | 206/391 |
| 3,073,435 | 1/1963 | Devon | 206/459 |
| 3,437,195 | 4/1969 | Hill | 206/226 |
| 3,530,980 | 9/1968 | Link | 206/394 |
| 3,562,999 | 2/1971 | Barbedienne | 206/45.33 X |
| 3,862,597 | 1/1975 | Martin | 242/55.2 X |

*Primary Examiner*—Leonard Summer
*Attorney, Agent, or Firm*—Joseph J. Grass

[57] ABSTRACT

There is disclosed a label roll package including a tray, label rolls disposed in side-by-side relationship in the tray, the rolls having aligned central holes defining a tubular space, a container disposed in the space, an ink roller disposed in the container, and plastics film material shrink-wrapped completely about and exerting pressure against the tray and the label rolls to provide a stable package.

7 Claims, 6 Drawing Figures

LABEL ROLL PACKAGE

BACKGROUND OF THE INVENTION

1. Field of the Invention

This invention relates to the art of label roll packages.

2. Brief Description of the Prior Art

The following U.S. patents are made of record:

| | | |
|---|---|---|
| 354,984 | J. Keleher | Dec. 28, 1886 |
| 2,748,931 | J. Taylor | June 5, 1956 |
| 2,912,102 | A. Scott | Nov. 10, 1959 |
| 3,161,999 | G. Klusmire | Dec. 22, 1964 |
| 3,338,399 | R. Burt | Aug. 29, 1967 |
| 3,562,999 | R. Barbedienne | Feb. 16, 1971 |

The Keleher patent discloses a container, a compound braid roll and a case therefor. The Taylor patent discloses a dispensing container for a plurality of rolls. The Scott patent discloses a package for spools wrapped with a transparent plastics material. The Klusmire patent discloses a tray of objects overwrapped with plastics film material in which a shaping tool is used for forcing the material to at least partially conform to the contents. The Burt patent discloses a package wrapped with a heat shrinkable film which is subjected to heat to cause the overwrap film to shrink snugly around the frame to increase the rigidity of the frame structure. The Barbedienne patent discloses a container for packing flexible tubes in an envelope that is contracted by heat.

SUMMARY OF THE INVENTION

The invention relates to a low-cost package. According to a preferred embodiment, a series of label rolls are disposed in side-by-side relationship in a tray. The tray has a pair of opposite side panels, a pair of opposite end panels and a bottom panel joined to the side and end panels. The tray has a recorder section provided by a weakening line. Each roll has a central hole, and the holes of the label rolls are aligned to provide a tubular space. A container for an ink roller is disposed in the opening. Plastics film material is shrink-wrapped about and exerts pressure against the tray and the label rolls to provide a stable package. At least one end panel is shaped to enable the container to be inserted into the space while the label rolls are in the tray but before the film material is applied. The film material is sufficiently transparent to enable indicia on the labels to be read. It is preferred that the film material completely and snugly envelope the tray and the label rolls so as to hermetically seal the label rolls from the atmosphere. It is also preferred that the container be of a type for hermetically sealing the ink roller to prevent evaporation of the volatile materials in the ink. In one embodiment the recorder section is comprised by the entire bottom panel, and in another embodiment the recorder section is comprised of a portion of the bottom panel which is spaced inwardly from the periphery of the bottom panel.

DETAILED DESCRIPTION OF THE PREFERRED EMBODIMENTS

Figure 2:
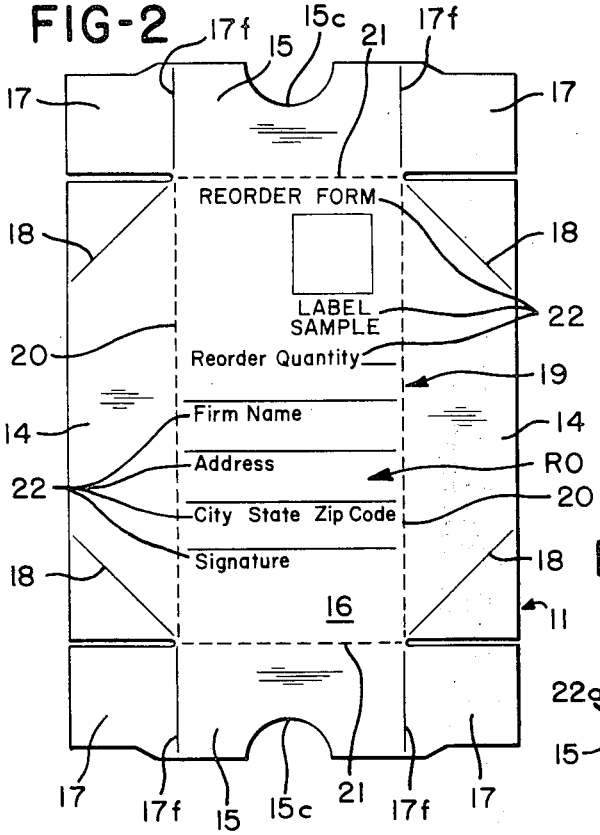
FIG. 2 is a bottom plan view, on an enlarged scale, of a blank for making a tray as shown in FIGS. 1, 3, 4 and 5.
Figure 1:
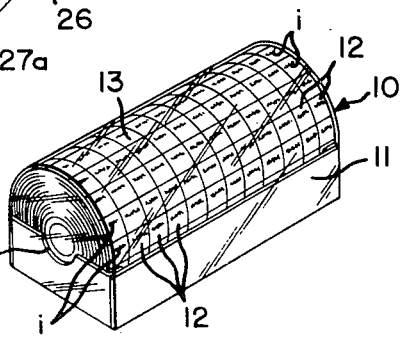
FIG. 1 is a perspective view of a label roll package according to a preferred embodiment.
Figure 5:
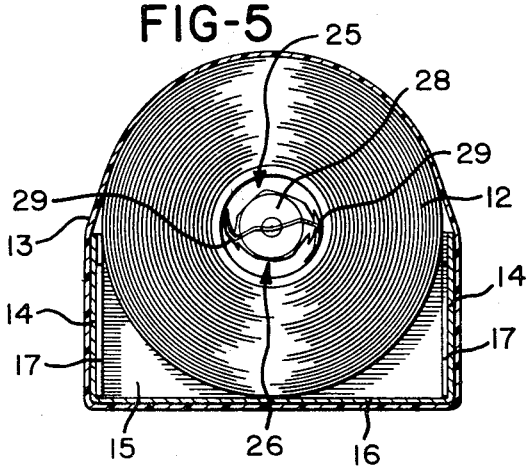
FIG. 5 is a transverse sectional view through the package.

Referring to FIG. 1, there is shown a label roll package generally indicated at 10 including a tray 11 containing label rolls 12, and an overwrap of heat-shrinkable plastics film material 13. The material 13 is sufficiently transparent to enable indicia i on labels 12*l* of the rolls 12 to be seen through the material 13.

with reference to FIG. 2, the tray is made up from a blank having opposite side panels 14 and opposite end panels 15 joined by a bottom panel 16. Pairs of flaps 17 are joined to each end panel 15 at fold lines 17*f*. Weakening lines 18 are formed at the ends of the side panels 14. A continuous weakening line generally indicated at 19 includes respective parallel weakening line portions 20 at the intersections of the side panels 14 and the bottom panel 16 and further includes respective parallel weakening line portions 21 at the intersections of the end panels 15 and the bottom panel 16. The fold lines 17*f* and 18 are shown to be score lines, while the weakening line 19 is shown to be a perforation line. The weakening line 19 is thus disposed at the periphery of the bottom panel 16. The line portions 20 are also the fold lines for the side panels 14 and the line portions 21 are also the fold lines for the end panels 15. The bottom panel 16 provides a reorder section RO having various indicia 22 relating to reordering labels. The other side of the reorder section can comprise indicia 22*a* such such as a name and address to which the reorder section RO can be forwarded in the manner of a post card.

Figure 3:
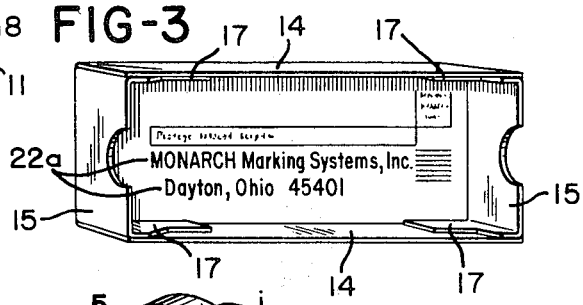
FIG. 3 is a perspective view of a set-up tray.

The side and end panels 14 and 15 and flaps 17 are folded as shown in FIG. 3 and thereupon the flaps 17 are adhesively secured to the side panels 14. If desired the tray 11 shown in FIG. 3 can be collapsed about fold lines 18 until ready to be used.

Figure 4:
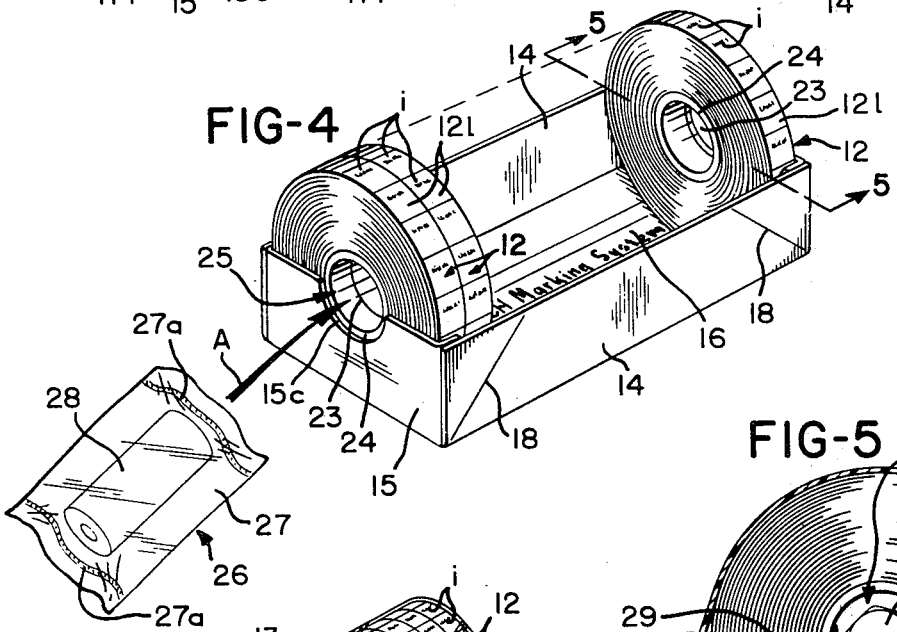
FIG. 4 is a perspective view of the tray containing label rolls.

With the tray 11 in the set-up condition shown in FIG. 4 for example, the label rolls 12 can be loaded into the tray in side-by-side contacting relationship. The sides of the endmost rolls 12 contact the end panels 15 and the bottom surfaces of all the rolls 12 contact and are supported by the bottom panel 16. The sides of the peripheries of the endmost rolls 12 contact the flaps 17, and the side panels 14 are brought into contact with the sides of the peripheries of the intermediate rolls 12 when the plastics film material 13 is shrunk about the tray 11 and the label rolls 12 as shown in FIG. 1.

Each label roll 12 is shown to have the same outside diameter and to have a central hole 23 provided by a central core 24. The central holes 23 are aligned to provide a generally tubular space generally indicated at 25. A container generally indicated at 26 in the form of a envelope composed of tubular plastics film material 27 heat sealed at 27*a* and containing an ink roller 28 is inserted as indicated by arrow A into the space 25 before the shrink-wrap material 13 is applied. The side panels 15 are of such an extent as not to cover the entrance to the space 25. More specifically, the side panels 15 are provided with cutouts 15*c*. The remainder parts of the panels 15 extend to a level of about the axis of the label roll 12, that is, to about one-half the diameter of the label roll 12, and the same is true for the side panels 14. As the tray extends to substantially less than the height of the rolls 12, the material 13 can exert holding pressure against the upper portions of the rolls 12 to hold the rolls 12 together and to hold the rolls 12 and the tray 11 together into a stable package. The film material 28 buckles over as indicated at 29 to hold the container 26 frictionally against the cores 24 within the space 25. The container 26 is constructed of a suitable plastics material 27 which is relatively impervious to ink and the transfer of vapor from the ink roller 28 so that the ink roller 28 does not dry out, and the plastics material 13 is relatively impervious to the transfer of vapor so that the label rolls 12 do not take on moisture from the surrounding atmosphere. In that the ink roller 28 is completely enclosed in the container 26, the ink roller 28 is hermetically sealed, and in that the tray 11 and the label rolls 12 are completely enclosed in the shrink wrap material 13, the label rolls 12 are hermetically sealed from the atmosphere. The film materials 13 and 27 can be constructed of any suitable material such as polyethylene, polypropylene, polyvinyl chloride, or the like. While the material 27 is being applied, it shrinks due to the application of heat to the material 27 and consequently a stable package results.

It is noted that when one or more label rolls 12 are required to be used the shrink-wrap material 13 is removed and the tray 11 is used as a holder for remaining roll 13. The reorder section RO can be separated from the remainder of the tray 11 when it is desired to order additional label rolls 13, by tearing along the weakening line 19.

Figure 6:
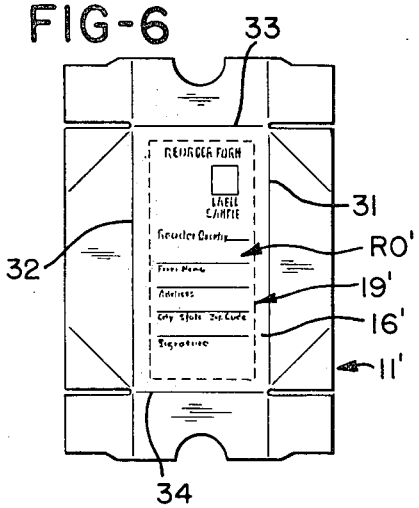
FIG. 6 is a bottom plan view on a reduced scale from the scale of FIG. 2 showing a reorder section formed within the periphery of the bottom panel.

The embodiment of FIG. 6 is identical to the embodiment of FIGS. 1 through 5 except that reorder section RO′ of a tray 11′ is formed by a weakening line 19′ which is spaced inwardly from fold lines 30, 31, 32 and 33. The weakening line 19′ is shown to be a perforation line, and the lines 30 through 33 are shown to be score lines. Thus, the record section RO′ is spaced inwardly from the periphery of the bottom panel 16′, so that removal of the reorder section RO′ does not destroy the integrity of the tray 11′ as a holder for label rolls.

If desired the reorder section can be comprised of other panels of the tray or can be comprised of more than one panel or portions of more than one panel.

Other embodiments and modifications of this invention will suggest themselves to those skilled in the art, and all such of these as come within the spirit of this invention are included within its scope as best defined by the appended claims.

I claim:

1. A label roll package, comprising: a tray including a pair of opposite side panels and a pair of opposite end panels extending upwardly from a bottom panel, a plurality of side-by-side rolls of labels received in the tray, the spacing between the side panels being substantially equal to the diameter of the label rolls, the height of the side panels being less than the diameter of the label rolls so that the label rolls extend above the side panels, the label rolls having generally aligned corresponding center holes, a container disposed in the center space defined by the center holes and enclosing an inking member, at least one of the end panels of the tray defining an opening aligned generally with the center holes for inserting the container and the inking member into the center space of the label rolls after the rolls are placed within the tray, a plastic film material shrink-wrapped about and substantially enclosing the tray and the rolls and exerting pressure against the tray and the label rolls to provide a unitized package, and the film material being effective to retain the container and inking member within the center space and being sufficiently transparent to enable indicia on the labels to be read.

2. A label roll package, comprising: a tray including a pair of opposite side panels and a pair of opposite end panels extending upwardly from a bottom panel, a plurality of side-by-side rolls of labels received in the tray, the spacing between the side panels being substantially equal to the diameter of the label rolls, the height of the side panels being less than the diameter of the label rolls so that the label rolls extend above the side panels, the labels rolls having generally aligned corresponding center holes, a container disposed in the center space defined by the center holes and enclosing an inking member, at least one of the end panels of the tray defining an opening aligned generally with the center holes for inserting the container and the inking member into the center space of the label rolls after the rolls are placed within the tray, a plastic film material shrink-wrapped about and substantially enclosing the tray and the rolls, the plastic film material exerting pressure against the tray and the label rolls to provide a unitized package, the film material being effective to retain the container and inking member within the center space and being sufficiently transparent to enable indicia on the labels to be read, and the tray including a weakening line forming a removable reorder section having indicia relating to reordering.

3. A label roll package as defined in claim 2, wherein the weakening line is disposed along the periphery of the bottom panel.

4. A label roll package as defined in claim 2, wherein the weakening line is spaced inwardly from the periphery of the bottom panel.

5. A label roll package, comprising: a tray including a pair of opposite side panels and a pair of opposite end panels extending upwardly from a bottom panel, a plurality of side-by-side rolls of labels received in the tray, the spacing between the side panels being substantially equal to the diameter of the label rolls, the height of the side panels being equal to approximately one-half the diameter of the label rolls so that the label rolls extend above the side panels, the label rolls having generally aligned corresponding center holes, a container disposed in the center space defined by the center holes and enclosing an inking member, at least one of the end panels of the tray defining an opening aligned generally with the center holes for inserting the container and the inking member into the center space of the label rolls after the rolls are placed within the tray, a plastic film material shrink-wrapped about and substantially enclosing the tray and the rolls, the plastic film material exerting pressure against the tray and the label rolls to provide a unitized package, and the film material being effective to retain the container and inking member within the center space and being sufficiently transparent to enable indicia on the labels to be read.

6. A label roll package as defined in claim 5 wherein the tray includes reorder section provided by a weakening line.

7. A label roll package, comprising: a tray including a pair of opposite side panels and a pair of opposite end panels extending upwardly from a bottom panel, a plurality of side-by-side rolls of labels received in the tray, the spacing between the side panels being substantially equal to the diameter of the label rolls, the height of the side panels being generally equal to one-half the diameter of the label rolls so that the label rolls extend above the side panels, the height of the end panels being generally equal to the height of the side panels, the label rolls having generally aligned corresponding center holes, a container disposed in the center space defined by the center holes and enclosing an inking member, at least one of the end panels of the tray defining a recess-like opening aligned generally with the center holes for inserting the container and the inking member into the center space of the label rolls after the rolls are placed within the tray, a plastic film material shrink-wrapped about and substantially enclosing the tray and the rolls, the plastic film material exerting pressure against the tray and the label rolls to provide a unitized package, and the film material being effective to retain the container and inking member within the center space and being sufficiently transparent to enable indicia on the labels to be read.

* * * * *